US010301908B2

(12) United States Patent
Wakefield et al.

(10) Patent No.: US 10,301,908 B2
(45) Date of Patent: May 28, 2019

(54) INTERVENTIONLESS PRESSURE OPERATED SLIDING SLEEVE WITH BACKUP OPERATION WITH INTERVENTION

(71) Applicant: BAKER HUGHES, A GE Company, LLC, Houston, TX (US)

(72) Inventors: John K. Wakefield, Cypress, TX (US); Alexander Kendall, Houston, TX (US); Stephen A. Graham, Houston, TX (US); Pete J. Clark, Houston, TX (US)

(73) Assignees: BAKER HUGHES, A GE COMPANY, LLC, Houston, TX (US); CHEVRON USA, INC., San Ramon, CA (US)

( * ) Notice: Subject to any disclaimer, the term of this patent is extended or adjusted under 35 U.S.C. 154(b) by 207 days.

(21) Appl. No.: 15/428,747

(22) Filed: Feb. 9, 2017

(65) Prior Publication Data

US 2018/0223626 A1 Aug. 9, 2018

(51) Int. Cl.

| | |
|---|---|
| ***E21B 34/10*** | (2006.01) |
| ***E21B 34/14*** | (2006.01) |
| ***E21B 34/06*** | (2006.01) |
| *E21B 34/00* | (2006.01) |

(52) U.S. Cl.

CPC ..... *E21B 34/10* (2013.01); *E21B 34/063* (2013.01); *E21B 34/066* (2013.01); *E21B 34/102* (2013.01); *E21B 34/14* (2013.01); *E21B 2034/007* (2013.01)

(58) Field of Classification Search

CPC .. E21B 2034/007; E21B 34/063; E21B 34/10; E21B 34/101

See application file for complete search history.

(56) References Cited

U.S. PATENT DOCUMENTS

| | | | | |
|---|---|---|---|---|
| 4,473,122 | A | 9/1984 | Tamplen | |
| 5,411,095 | A | 5/1995 | Ehlinger et al. | |
| 5,443,124 | A | 8/1995 | Wood et al. | |
| 2007/0089887 | A1 | 4/2007 | Gomez | |
| 2010/0051289 | A1 | 3/2010 | Constantine et al. | |
| 2011/0100643 | A1* | 5/2011 | Themig ..... | E21B 34/102 166/373 |

(Continued)

FOREIGN PATENT DOCUMENTS

| | | |
|---|---|---|
| WO | 9730269 | 8/1997 |
| WO | 2009023611 | 2/2009 |

*Primary Examiner* — D. Andrews

(74) *Attorney, Agent, or Firm* — Shawn Hunter

(57) ABSTRACT

An array of sliding sleeve valves are uniquely addressable without control lines or wires to open for a treatment and then close and then selectively open for production. The discrete movements employ an available pressure source such as tubing pressure and change the piston areas on opposed sides of a sliding sleeve valve to get the desired movements. Access valves to tubing pressure can be actuated in a desired sequence with signals such as acoustic or electromagnetic, for example. Access to one piston area that communicates opposed and offsetting piston areas to the tubing hydrostatic can be achieved with a straddle tool breaking a rupture disc. The piston is then in pressure balanced and can be moved in a desired direction with the straddle tool straddling access locations to the piston from above or below.

18 Claims, 3 Drawing Sheets

(56) References Cited

U.S. PATENT DOCUMENTS

2011/0132599 A1* 6/2011 Xu ..... E03B 3/15
166/228
2015/0122489 A1* 5/2015 Wood ..... E21B 43/14
166/250.01

* cited by examiner

INTERVENTIONLESS PRESSURE OPERATED SLIDING SLEEVE WITH BACKUP OPERATION WITH INTERVENTION

FIELD OF THE INVENTION

The field of the invention is borehole tools operated between multiple positions with interventionless signaling to pressurized fluid sources associated with the borehole tool or a surrounding annulus in the borehole.

BACKGROUND OF THE INVENTION

Sliding sleeves in tubular strings have been moved in the past with direct application of hydraulic pressure applied to a sealed chamber where the sleeve acts as a piston. Rising pressure puts a force on the sleeve to change its position. This is a sleeve actuation method frequently used in subsurface safety valves such as in U.S. Pat. No. 4,473,122. Other ways of moving a sleeve are to use ball screws or similar mechanical devices to force a sleeve to translate or to rotate as shown in WO97/30269.

Sleeve valves are frequently used in fracturing where ports are covered by a sleeve when running in and subsequently opened for treatment. After treatment the ports are closed with sleeve movement and then need to be reopened when the entire zone is treated for production from the formation. One way this is done now is to shift a sleeve with pressure on a ball landed on a seat supported by the sliding sleeve so that the ports are opened for treatment. After the treatment through an opened valve is concluded another ball that is larger lands on the next sleeve uphole and in effect isolates the ports opened by the previous sleeve so that treatment at the next set of ports in an uphole direction can take place. This process is repeated with progressively larger balls until the entire interval is treated. After that, all the balls are drilled out and if needed certain sleeves are closed with a shifting tool before production begins through the open sleeves. There are drawbacks to this well-known method of fracturing or otherwise treating a formation. There can be a large number of balls that have to be delivered in size order that are only minimally different in diameter. This can cause operator confusion. The sleeves have seats that restrict the produced fluid flow to some degree. The milling is time consuming and creates debris in the borehole that can adversely affect the operation of other tools with small clearances.

Sliding sleeves can be individually moved with one or more control lines to each sleeve but using this technique in situations with many sleeves is expensive and time consuming. Another way is to send power to operators for sleeves through a wired system. This technique is also expensive and time consuming. Valve members have been designed to be pressure responsive to pressure cycling using unequal piston areas and a j-slot mechanism to operate a single sleeve. However, this design is not useful with arrays of valve members that need to be distinctly addressable to move in a predetermined sequence.

The method and apparatus of the present invention provides an interventionless way to open, then close and then reopen specific sliding sleeves so that a particular sleeve can provide access for treatment and then get closed as another sleeve is actuated to continue the treatment. Thereafter a selected sleeve can be reopened and optionally locked open for production. Ball seats and milling are eliminated allowing for production to begin that much faster. The movement of the sleeve is accomplished with signal responsive valves that direct tubing hydrostatic pressure to different piston areas on opposed sides of a piston to make the piston move in the direction desired. Tubing or annulus pressure can be employed if the annulus is not cemented. An option is available for intervention in the tubing such as with a straddle tool that can preferably equalize the piston areas on opposed sides of the piston and allow piston movement with pressure applied through the straddle packer tool. These and other aspects of the present invention will be more readily apparent from a review of the description of the preferred embodiment and the associated drawings while recognizing that the full scope of the invention is to be determined by the appended claims.

SUMMARY OF THE INVENTION

An array of sliding sleeve valves are uniquely addressable without control lines or wires to open for a treatment and then close and then selectively open for production. The discrete movements employ an available pressure source such as tubing pressure and change the piston areas on opposed sides of a sliding sleeve valve to get the desired movements. Access valves to tubing pressure can be actuated in a desired sequence with signals such as acoustic or electromagnetic, for example. Access to one piston area that communicates opposed and offsetting piston areas to the tubing hydrostatic can be achieved with a straddle tool breaking a rupture disc. The piston is then in pressure balanced and can be moved in a desired direction with the straddle tool straddling access locations to the piston from above or below.

DETAILED DESCRIPTION OF THE PREFERRED EMBODIMENT

Figure 1:
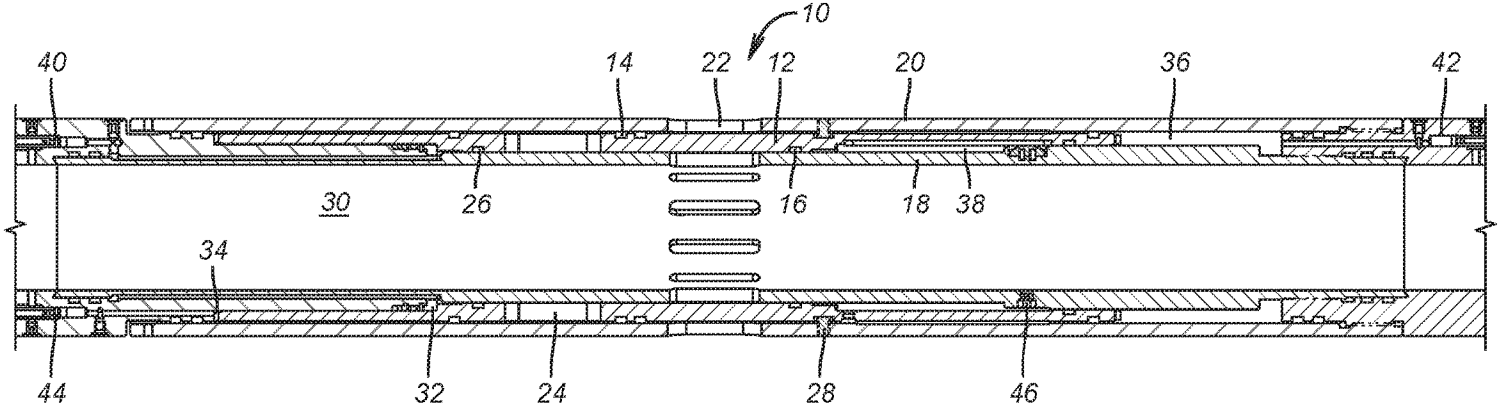
FIG. 1 is a section view of a valve run in closed.

Referring to FIG. 1, valve 10 is one of an array of valves that are used to treat a zone in a borehole. Each valve is operable without intervention in the borehole so that a predetermined sequence of operation can be achieved. In a fracturing operation the valves 10 are operated one at a time to open after they are all run in closed. After the treatment at one such valve, that valve 10 is closed and a different valve 10 is opened and the treatment is repeated. Eventually when the treatment has occurred through the desired valves and they are all in the closed state again one or more can be reopened such as for production. Preferably each valve 10 can be uniquely addressed without intervention and without connection of control lines or wires. Preferably the valves 10 are structurally the same with the exception of the configuration of each valve to respond to unique signals to that valve for control of the opening and closing functions of each valve in the desired sequence.

Specifically, there is a sliding sleeve 12 that slides over a mandrel 18 and has an outer seal 14 against an outer housing 20 and an inner seal 16 against the mandrel 18. The seals 14 or 16 can be a single seal or multiple seals. Outer housing 20 has a port 22 and sliding sleeve 12 has a port 24 that in FIG. 1 is misaligned with port 22 for the run in closed position. Seal 26 is against the mandrel 18 and on the opposite side of port 24 from outer seal or seals 14. Shear pin 28 holds the FIG. 1 position until force is applied make sliding sleeve 12 translate between the mandrel 18 and the outer housing 20.

There are four chambers that can be selectively communicated to tubing hydrostatic pressure in passage 30. There is no need to add to tubing hydrostatic pressure. Alternatively, if the annulus is open to pressure annulus hydrostatic can be used. If the annulus is cemented then tubing hydrostatic in passage 30 is used. To get the capability to open, close and reopen without intervention in passage 30 there are three chambers needed. To operate a given valve 10 with intervention on top of being able to open, close and reopen the valve 10 a fourth chamber is used. Chambers 32 and 34 communicate to the uphole side of the sliding sleeve 12 and chambers 36 and 38 communicate to the downhole side of the sliding sleeve 12. Remotely actuated valves 40, 42 and 44 respectively communicate hydrostatic pressure in passage 30 to chambers 32, 36 and 34. As stated before these valves 40, 42 and 44 respond to unique signals that can be acoustic or electromagnetic or coded pressure pulses to name a few options to operate in a predetermined sequence for moving sliding sleeve 12 between open and closed positions. Another power source can be electric power. It would rely on use of a toroidal current sensor attached to the electronic valves such as 40, 42 and 44 and an electrical gap on the OD of the toroid. The wound wire in the toroid (like a transformer coil) is excited by current along the surface of the casing (but that current must pass through the toroid and not leak to the OD outside it). Access to chamber 38 is through rupture disc 46 as will be explained with regard to FIG. 5, where intervention is used.

All the chambers 40, 42, 44 and 38 start at low or nearly atmospheric pressures. There is no need to pressurize these chambers before running in and cementing if that is to be done. To move from the FIG. 1 closed position to the FIG. 2 open position, valve 40 is signaled to open to hydrostatic pressure in passage 30 and that hydrostatic pressure is communicated to chamber 32 causing its volume to increase as the volumes of chambers 36 and 38 decrease. As tubing hydrostatic pressure acts on piston area 48 the sliding sleeve 12 moves right to align the ports 22 and 24 for the open position of valve 10 with seals 16 and 26 straddling the aligned ports 22 and 24 and against the mandrel 18 and seals 14 and 50 against the outer housing 20 and straddling the aligned openings 22 and 24. The low pressure in chambers 36 and 38 has increased with the volume reduction that those two chambers experience as the sliding sleeve 12 moved right to the open position of FIG. 2 with the hydrostatic pressure from passage 30 communicated through the interventionlessly operated valve 40. For the purposes of an example the piston area of 48 will be assumed to be 5.17 square inches. The movement of sliding sleeve 12 comes after shear pin or other temporary retainer 28 is disabled.

Figure 2:
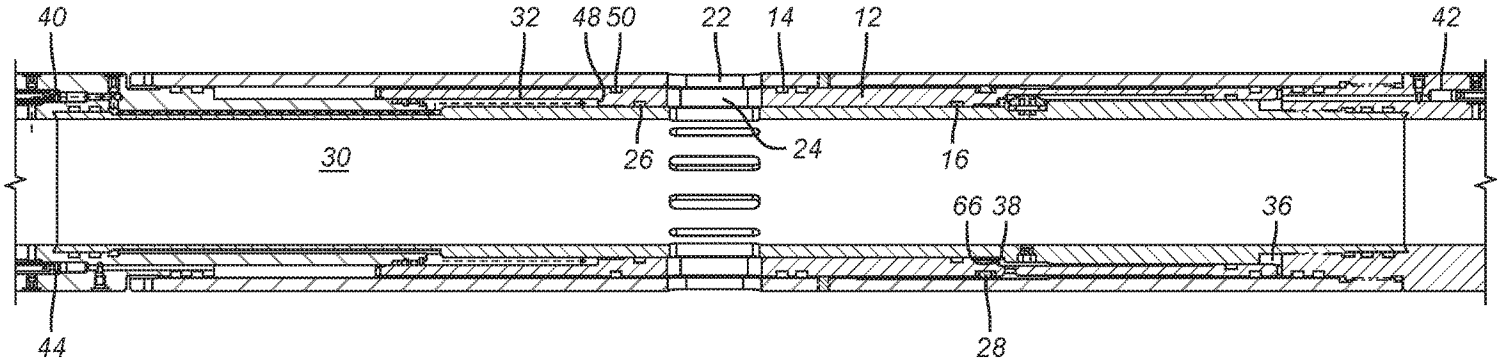
FIG. 2 is the view of FIG. 1 with the valve open.
Figure 3:
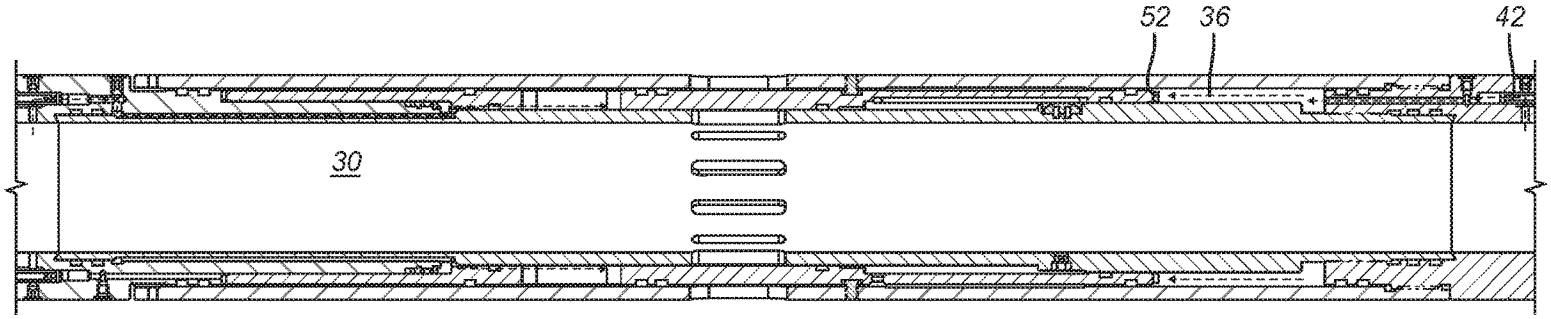
FIG. 3 is the view of FIG. 2 with the valve closed again.

To close valve 10 after it is opened, valve 42 is signaled open to allow hydrostatic in passage 30 to access chamber 36 to increase its volume as hydrostatic pressure is applied to piston area 52 which is greater than piston area 50 so that a net force to sliding sleeve is applied to reverse the FIG. 2 movement to resume the position of the sliding sleeve 12 in FIG. 1, i.e. the closed position. For example the piston area 52 can be 9.51 square inches which is greater than 5.17 square inches for piston area 50 so the net force is uphole in FIG. 3 back to the closed position.

Figure 4:
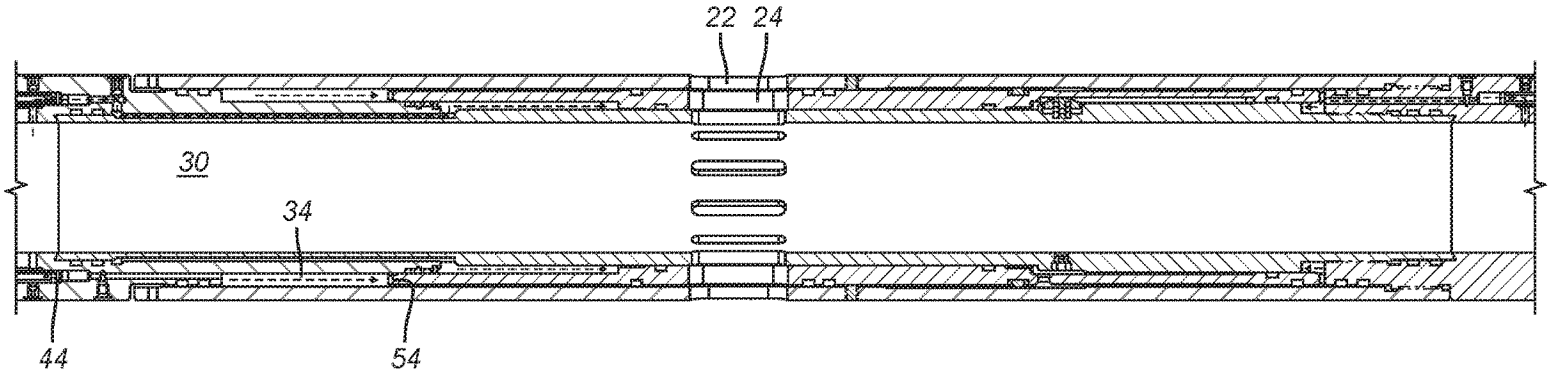
FIG. 4 is the view of FIG. 3 with the valve reopened such as for production.

FIG. 4 shows the further interventionless operation of valve 44 to allow hydrostatic pressure into chamber 34 from passage 30 to act on piston area 54 to make the total of piston areas 50 and 54 equal to 14.15 square inches above sliding sleeve and an area of 9.51 on piston area 52 so that the motion of sliding sleeve 12 is back to the right to the open position of ports 22 and 24 aligned for production, for example.

Figure 5:
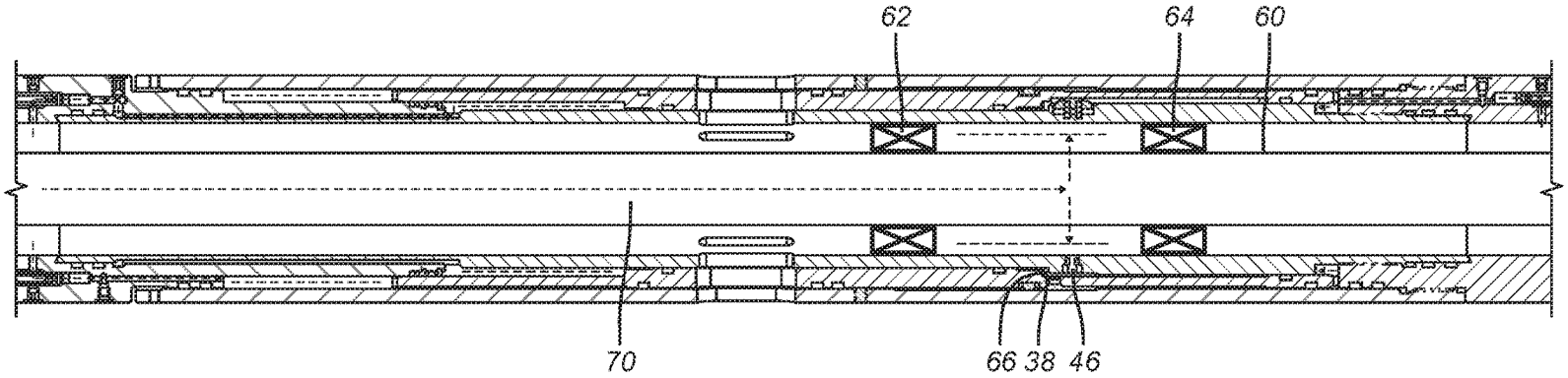
FIG. 5 is a view of FIG. 2 with the valve open and the sliding sleeve put in pressure balance with a straddle tool that then can be used to move the sliding sleeve between an open and a closed position.

FIG. 5 illustrates a use of chamber 38 or open valves 40 and 44 to move the sliding sleeve 12 in either direction with intervention with a straddle tool 60 that has spaced seals 62 and 64 that can be resettable packers such as an inflatable. In FIG. 5 the seals 62 and 64 straddle the rupture disc or other breakable member 46 while sealing against the mandrel 18. Applied pressure breaks the rupture disc 46 now communicating hydrostatic pressure in the straddle tool 60 to the chamber 38. Now the sum total of the piston areas 66 and 52 below sliding sleeve 12 and the piston areas 50 and 54 above sliding sleeve 12 are equal. At this point the sliding sleeve 12 is in pressure balance with hydrostatic pressure in passage 30 so applying pressure in the FIG. 5 orientation will put a net uphole force on sliding sleeve 12 to close the valve 10 from the shown open position of FIG. 5. It should be noted that the passage 70 in straddle tool 60 is initially open to passage 30 hydrostatic pressure. Once in position, the lower end of passage 70 can be closed for breaking shear pin 46 to put sliding sleeve 12 in pressure balance. Thereafter if the need is to close the valve 10 then the packers 62 and 64 do not need to be released or moved and pressure is simply applied in passage 70 to break the rupture disc 46 for access to chamber 38 to get sliding sleeve 12 in pressure balance to passage 30 hydrostatic pressure followed by increasing pressure in passage 70 to move sliding sleeve 12 uphole or left into the closed position. Alternatively, after breaking the rupture disc 46, the seals 62 and 64 can be released, the tool 60 moved uphole to straddle open valves 40 or 44 or both and with the seals 62 and 64 extended to mandrel 18 the pressure in passage 70 is increased to alter the pressure balance on sliding sleeve 12 with an applied force to piston areas 48 and/or 52 to get valve 10 that had been closed into the open position.

Those skilled in the art will appreciate the various advantages of the device described above. First there can be an array of valves in a zone of interest that can be sequentially addressed without intervention and without the need to run control lines or wires to each valve that communicates hydrostatic tubing pressure to variable volume chambers in a sequential manner to obtain at least three movements of a sliding sleeve. In the preferred embodiment three chambers allow three sleeve movements in opposing direction to open a closed valve for treatment and then close it after treatment and then open it for production, for example. Using a chamber and a remotely actuated valve associated with the chambers there can be as many sliding sleeve movements as there are valves and associated chambers. In another feature of the above described device, there is a chamber that can be accesses with intervention that has the benefits of equalizing opposed piston areas to make the sliding sleeve easier to move with less applied pressure to essentially overcome seal friction. The other and further advantage is that the straddle tool that breaks a rupture disc or the like to gain access to the chamber to equalize opposing piston areas can also be used to add pressure below or above the sliding sleeve in its pressure balanced configuration to either close or open the valve assuming at least one of the valves or the rupture disc to passage 30 have opened. The various chambers on one side of the sliding sleeve can be circumferentially offset to allow room for more chambers and associated tubing hydrostatic access valves. At some point a tradeoff occurs between how many chambers and associated valves are put on either side of the sliding sleeve when the point is reached that the drift dimension of passage 30 needs reduction to accommodate more chambers while retaining the needed pressure rating of the assembly. The sliding sleeve is in pressure balance from the two chambers on each side before any passage valves open because all the chambers are at or near atmospheric pressure and the piston areas on opposite sides offset each other. Alternatively, the chambers can be at the available hydrostatic and the system will operate to the extent pressure can be applied to the passage in the housing to have available a pressure difference when the remotely actuated valves open. This can occur if during running in there is a condition where there is flow past a seal. Normally the chambers would be closed with seals at the surface rather than being pressurized before running in to the expected hydrostatic pressure.

The above description is illustrative of the preferred embodiment and many modifications may be made by those skilled in the art without departing from the invention whose scope is to be determined from the literal and equivalent scope of the claims below:

We claim:

1. A valve assembly comprising a plurality of valves for selective access to a zone of interest from a borehole, comprising:

a housing having a passage therethrough;

a sliding sleeve moveably mounted to said housing between a lateral port open and a lateral port closed positions;

remotely actuated valving to selectively communicate at least available hydrostatic pressure from said passage or from an annular space in the borehole around said housing to opposed sides of said sliding sleeve, without borehole intervention, to move said sliding sleeve between said lateral port open and closed positions more than twice;

said valving comprising:

a first valve leading to a first chamber on one side of said sliding sleeve having a first piston area on said sliding sleeve to move said sliding sleeve in a first direction using said hydrostatic pressure from said passage or said annulus;

a second valve leading to a second chamber on an opposite side of said sliding sleeve from said first chamber and having a second piston area on said sliding sleeve to move said sliding sleeve in a second direction opposite said first direction using said hydrostatic pressure from said passage or said annulus, wherein said second piston area exceeds said first piston area; and a third valve leading to a third chamber on the same side of said sliding sleeve as said first chamber and having a third piston area on said sliding sleeve, such that said first and third piston areas, exceed said second piston area to move said sliding sleeve in said first direction a second time using said hydrostatic pressure from said passage or said annulus, wherein said first and third piston areas exceed said second piston area.

2. The assembly of claim 1, wherein:

said valving is actuated by acoustic, pressure pulse, electric current or electromagnetic signals.

3. The assembly of claim 1, wherein:

said valving opening communication to variable volume chambers located on opposed sides of said sliding sleeve.

4. The assembly of claim 3, wherein:

said chambers are sealed to said housing and defined by a discrete piston area on said sliding sleeve.

5. The assembly of claim 1, wherein:

said chambers initially contain a pressure lower than hydrostatic pressure in said passage or said annulus in which case operation of said valving allows available hydrostatic pressure in said passage or said annulus to move said sliding sleeve, or said chambers initially contain a pressure as high as said hydrostatic pressure in said passage or annulus in which case operation of said valving and pressure addition in said passage or said annulus to available hydrostatic pressure will be needed to move said sliding sleeve.

6. The assembly of claim 5, wherein:

said sliding sleeve is in pressure balance from said chambers before any of said valving is opened.

7. The assembly of claim 1, wherein:

movement in said first direction places said sliding sleeve in said lateral port open position and movement of said sliding sleeve in said second direction puts said sliding sleeve in said lateral port closed position.

8. The assembly of claim 7, further comprising:

a fourth chamber selectively accessible to said passage and exposed to a fourth piston area on said sliding sleeve, said fourth piston area additive to said second piston area to balance said second and said fourth piston areas with said first and third piston areas to put said sliding sleeve in pressure balance to hydrostatic pressure in said passage or annulus.

9. The assembly of claim 8, wherein:

said fourth chamber selectively accessible from said passage with a pressure responsive breakable member broken with a straddle tool that enables application of pressure to break said breakable member to communicate said fourth chamber to hydrostatic pressure in said passage.

10. The assembly of claim 9, wherein:

said sliding sleeve moveable into said port closed position by pressurizing said fourth chamber after breaking said breakable member and delivering pressure to said fourth chamber from said straddle tool without repositioning of said straddle tool.

11. The assembly of claim 9, wherein:

said sliding sleeve moveable into said port open position by breaking said breakable member for communicating passage hydrostatic pressure to said fourth chamber and delivering pressure to said first or third chamber from a relocated said straddle tool for pressure delivery to said first or third chamber.

12. The assembly of claim 1, further comprising:

a breakable member in said passage to provide selective access to said sliding sleeve;

a straddle tool to selectively straddle and break said breakable member or to direct pressure to another access location to said sliding sleeve from said passage through said valving for a backup way to move said sliding sleeve to said lateral port open or closed positions.

13. The assembly of claim 12, wherein:

breaking said breakable member equalizes opposed sides of said sliding sleeve to said hydrostatic pressure in said passage from prior opening of said valving.

14. A method of access to a zone in a borehole, comprising:

sequentially communicating at least hydrostatic pressure to opposed sides of a sliding sleeve in a housing comprising a passage and against a lower reference pressure in a manner where net piston area exposed to said sliding sleeve changes with each discrete communication to move said sliding sleeve between a lateral port open and a lateral port closed positions in at least three movements without intervention in said passage;

obtaining said three movements with first, second and third remotely actuated valves communicating hydrostatic pressure respectively to first, second and third chambers with said first and third chambers exposed to one side of said sliding sleeve and said second chamber exposed to an opposite side of said sliding sleeve, wherein said first, second and third chambers define respective first, second and third piston areas on said sliding sleeve;

making said second piston area larger than said first piston area and the total of said first and third piston areas larger than said second piston area;

referencing said first chamber to a lower pressure than said hydrostatic pressure before said first, second and third valves are opened; and obtaining said three movements with sequential opening of said first, second and third valves.

15. The method of claim 14, comprising:

providing a fourth chamber accessible from said passage having an fourth piston area on said sliding sleeve;

putting said sliding sleeve in pressure balance from hydrostatic in said passage by making said second and fourth piston areas equal to said first and third piston areas.

16. The method of claim 15, comprising:

providing a backup way to move said sliding sleeve by accessing said fourth chamber from said passage by breaking a breakable member with a straddle tool;

applying pressure through said straddle tool into said fourth chamber through said broken breakable member to move said sliding sleeve to said lateral port closed position.

17. The method of claim 15, comprising:

providing a backup way to move said sliding sleeve by accessing said fourth chamber from said passage by breaking a breakable member with a straddle tool;

moving said straddle tool to access said first or third chambers to move said sliding sleeve to said lateral port open position with pressure applied through said straddle tool.

18. The method of claim 14, comprising:

actuating said first, second or third valves to open with an acoustic, electric current, pressure pulse or electromagnetic signal from a remote location.

* * * * *